US007083401B2

(12) United States Patent
Hooper

(10) Patent No.: US 7,083,401 B2
(45) Date of Patent: Aug. 1, 2006

(54) ASYMMETRIC CONTOURING OF ELASTOMER LINER ON LOBES IN A MOINEAU STYLE POWER SECTION STATOR

(75) Inventor: Michael E. Hooper, Spring, TX (US)

(73) Assignee: Dyna-Drill Technologies, Inc., Houston, TX (US)

( * ) Notice: Subject to any disclaimer, the term of this patent is extended or adjusted under 35 U.S.C. 154(b) by 115 days.

(21) Appl. No.: 10/975,671

(22) Filed: Oct. 27, 2004

(65) Prior Publication Data

US 2005/0089430 A1 Apr. 28, 2005

Related U.S. Application Data

(60) Provisional application No. 60/514,848, filed on Oct. 27, 2003.

(51) Int. Cl.
*F03C 2/00* (2006.01)
*F04C 18/00* (2006.01)

(52) U.S. Cl. ..... 418/48; 418/152; 418/153; 418/179

(58) Field of Classification Search ..... 418/48, 418/152, 153, 178, 179
See application file for complete search history.

(56) References Cited

U.S. PATENT DOCUMENTS

| | | | | |
|---|---|---|---|---|
| 2,527,673 | A | 10/1950 | Byram | |
| 3,084,631 | A | 4/1963 | Bourke | |
| 3,139,035 | A | 6/1964 | O'Connor | |
| 3,417,664 | A | 12/1968 | Brucker | |
| 3,499,389 | A | 3/1970 | Seeberger et al. | |
| 3,822,972 | A | 7/1974 | Ogly et al. | |
| 3,840,080 | A | 10/1974 | Berryman | |
| 3,857,654 | A | 12/1974 | Streicher | |
| 3,912,426 | A | 10/1975 | Tschirky | |
| 3,975,120 | A | 8/1976 | Tschirky | |
| 4,104,009 | A | 8/1978 | Chanton | |
| 4,144,001 | A | 3/1979 | Streicher | |
| 4,265,323 | A | 5/1981 | Juergens | |
| 4,415,316 | A | 11/1983 | Jurgens | |
| 4,558,991 | A | 12/1985 | Barr | |
| 4,614,232 | A | 9/1986 | Jurgens et al. | |
| 4,636,151 | A | 1/1987 | Eppink | |
| 4,676,725 | A | 6/1987 | Eppink | |
| 4,718,824 | A | 1/1988 | Cholet et al. | |
| 4,863,359 | A * | 9/1989 | Unterstrasser et al. | 418/48 |
| 5,090,497 | A | 2/1992 | Beimgraben et al. | |
| 5,145,342 | A | 9/1992 | Gruber | |
| 5,171,138 | A | 12/1992 | Forrest | |
| 5,171,139 | A | 12/1992 | Underwood et al. | |

(Continued)

FOREIGN PATENT DOCUMENTS

| | | | | |
|---|---|---|---|---|
| DE | 2017620 B | * | 4/1976 | 418/48 |

(Continued)

OTHER PUBLICATIONS

Baker Hughes, "X-Treme Motors Technology Overview," webpage available for download at http://www.bakerhughes.com/inteq/drilling/_xtreme/tech_overview.htm, 1 page.

*Primary Examiner*—Theresa Trieu

(57) ABSTRACT

The inventive stator includes a helical cavity component made from a material chosen to reinforce an elastomer liner deployed thereon. The contouring of the elastomer liner is asymmetrical, such that the elastomer liner is relatively thick on the loaded side of a lobe as compared to its thickness on the unloaded side of the lobe.

25 Claims, 3 Drawing Sheets

U.S. PATENT DOCUMENTS

| | | | | |
|---|---|---|---|---|
| 5,759,019 | A | 6/1998 | Wood et al. | |
| 6,019,583 | A | 2/2000 | Wood | |
| 6,183,226 | B1 | 2/2001 | Wood et al. | |
| 6,241,494 | B1 | 6/2001 | Pafitis et al. | |
| 6,309,195 | B1 | 10/2001 | Bottos et al. | |
| 6,427,787 | B1 | 8/2002 | Jager | |
| 6,543,132 | B1 | 4/2003 | Krueger et al. | |
| 6,568,076 | B1 | 5/2003 | Bottos et al. | |
| 6,604,921 | B1 | 8/2003 | Plop et al. | |
| 6,716,008 | B1 * | 4/2004 | Kachele | 418/48 |

FOREIGN PATENT DOCUMENTS

| | | | | |
|---|---|---|---|---|
| DE | 3322095 | A1 * | 12/1984 | 418/48 |
| GB | 2081812 | A | 2/1982 | |

* cited by examiner

ASYMMETRIC CONTOURING OF ELASTOMER LINER ON LOBES IN A MOINEAU STYLE POWER SECTION STATOR

RELATED APPLICATIONS

This application claims the benefit of U.S. Provisional Application Ser. No. 60/514,848 entitled Asymmetric Contouring of Elastomer Liner on Lobes in Moineau Style Power Section Stator, filed Oct. 27, 2003.

FIELD OF THE INVENTION

This invention relates generally to Moineau style power sections useful in subterranean drilling motors, and more specifically to the contouring of elastomer on lobes in the helical portion of stators in such power sections.

BACKGROUND OF THE INVENTION

Moineau style power sections are well known. They are useful in drilling motors for, e.g., subterranean drilling applications, in which they are used to covert a flow of drilling fluid into torque and rotary power. The general principle on which Moineau style power sections operate involves locating a helical rotor within a stator having a helical cavity. Helical cavity stators, when viewed in circular cross-section, show a series of peaks and valleys. The valleys are where the helical cavity is formed into the inside of the stator. The peaks are typically referred to as "lobes."

The furthest outside diameter of the rotor is generally selected so as to allow the rotor to rotate within the stator while maintaining close proximity to the lobes on the stator. In most conventional Moineau style power sections, the rotor and the lobes on the stator are preferably an interference fit, with the rotor including one fewer lobes than the stator. Then, when fluid (such as drilling fluid) is passed through the helical spaces between rotor and stator, the flow of fluid causes the rotor to rotate.

Stators in Moineau style power sections typically show at least two components in circular cross-section. The outer portion includes a hollow cylindrical metal tube. The inner portion includes a helical cavity component. The helical cavities are formed in the inner surface of the helical cavity component. The helical cavity component also has a cylindrical outer surface that abuts the inner surface of the hollow metal tube.

Conventional stators in Moineau style power sections also advantageously include elastomer (e.g. rubber) surfaces on the inside of the helical cavities, and preferably on the lobes, to facilitate the interference fit with the rotor. The elastomer provides a resilient surface with which to contact the rotor as the rotor rotates. Many stators are known where the helical cavity component is made substantially entirely of elastomer.

It has been observed in operations using Moineau style power sections that the elastomer portions of the lobes are subject to considerable cyclic deflection. This deflection is caused not only by the interference fit with the rotor, but also by reactive torque from the rotor. The cyclic deflection and rebound of the elastomer causes a build up of heat in the elastomer. In conventional stators, especially those in which the helical cavity component is made substantially entirely from elastomer, the heat build up has been observed to concentrate near the center of the lobe. The heat build up weakens the elastomer, leading to a premature "chunking" breakdown of the elastomer. A cavity in the lobe also eventually develops as the deteriorated elastomer separates and falls away. This causes loss of lobe integrity, which causes loss of interference fit with the rotor, resulting in fluid leakage between rotor and stator as fluid is passed through the power sections. This fluid leakage in turn causes loss of drive torque, and if left unchecked will eventually lead to stalling of the rotor.

In other stators, such as described in exemplary embodiments disclosed in commonly-assigned, co-pending U.S. patent application Ser. No. 10/694,557, "COMPOSITE MATERIAL PROGRESSING CAVITY STATORS," the elastomer may be a liner deployed on the helical cavity component, the helical cavity component comprising a fiber reinforced composite reinforcement material for the elastomer liner.

The deployment of a reinforcement material in the lobes addresses the problems of deterioration of an all-elastomer lobe due to heat build up. For example, lower resilience in the reinforcement material is likely to localize resilient displacement in the liner, where, in some embodiments, heat build up may dissipate more quickly. Care is required, however, in selection of reinforcement material and elastomer liner thickness. Contact stresses are caused on the reinforced lobes as the rotor rotates within the interference fit with the stator. Without sufficient resilience in the interference fit, the reinforcement may be too hard and/or the liner may be too thin, such that the contact stresses cause the elastomer liner to crack or split as the rotor contacts the stator lobe. Additionally, without care in choice of materials or elastomer liner thickness, the cyclic contact stresses can cause the lobes to crack or fail prematurely, particularly on the loaded side of the rotor/stator interface.

SUMMARY OF THE INVENTION

These and other needs and problems in the prior art are addressed by a stator comprising asymmetrical contouring of elastomer. The inventive stator includes a helical cavity component made from a material chosen to reinforce an elastomer liner deployed thereon. The contouring of the elastomer liner is asymmetrical, such that the elastomer liner is relatively thick on the loaded side of a lobe as compared to its thickness on the unloaded side of the lobe.

It is therefore a technical advantage of the invention to still provide reinforcement to an elastomer surface on the lobes on the helical cavity component. The problems caused by heat build up in the lobes may thus be addressed. At the same time, an elastomer liner is provided with a thickness profile having increased thickness, and therefore increased resilience, on the loaded side of a lobe. This increased resilience deters liner breakdown (or reinforcement breakdown) due to contact stresses between rotor and stator.

According to one aspect of the present invention a stator for use in a Moineau style power section is provided. The stator includes a plurality of internal stator lobes, each of which includes a resilient liner deployed on an interior surface of the stator. The liner is disposed to engage rotor lobes on a helical outer surface of a rotor when the rotor is positioned within the stator so that the rotor lobes are in a rotational interference fit with the stator lobes. Rotation of the rotor in a predetermined direction causes the rotor lobes to contact the stator lobes on a loaded side thereof as the interference fit is encountered and to pass by the stator lobes on a non-loaded side thereof as the interference fit is completed. Each of the stator lobes further includes a reinforcement material for the resilient liner. The stator further includes a shape, when viewed in circular cross section, in which a thickness of the liner is greater on the loaded sides of the stator lobes than on the non-loaded sides thereof.

According to another aspect, this invention includes a subterranean drilling motor. The drilling motor includes a rotor having a plurality of rotor lobes on a helical outer surface thereof and a stator including a helical cavity component. The helical cavity component provides an internal helical cavity and includes a plurality of internal stator lobes. The rotor is deployable in the helical cavity of the stator such that the rotor lobes are in a rotational interference fit with the stator lobes. Rotation of the rotor in a predetermined direction causes the rotor lobes to contact the stator lobes on a loaded side thereof as the interference fit is encountered and to pass by the stator lobes on a non-loaded side thereof as the interference fit is completed. The stator lobes include a reinforcement material and a resilient liner, the liner disposed to engage an outer surface of the rotor. The liner has a non-uniform thickness such that it is thicker on the loaded sides of the lobes than on the non-loaded sides of the lobes.

Certain exemplary embodiments of this invention may also include at least one transition layer separating the liner and the reinforcement material, the transition layers made from material that is less resilient than the liner, but more resilient than the reinforcement material.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

FIGS. 1 through 5 each depict circular cross-sections through Moineau style power sections in an exemplary ¾ design. In such a design, the differing helical configurations on rotor and stator provide, in circular cross section, 3 lobes on the rotor and 4 lobes on the stator. It will be appreciated that this ¾ design is depicted purely for illustrative purposes only, and that the present invention is in no way limited to any particular choice of helical configurations for the power section design.

Figure 1:
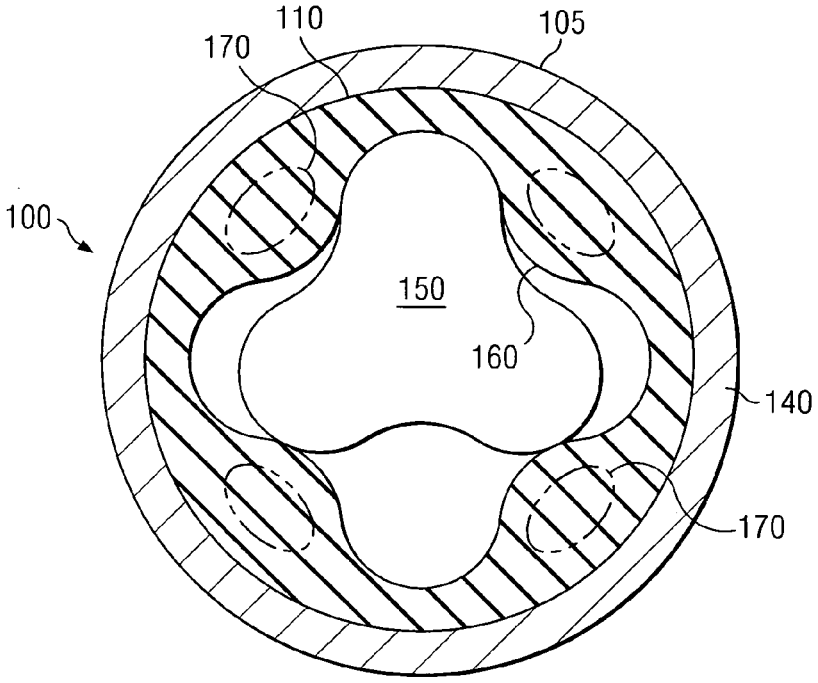
FIG. 1 (PRIOR ART)
FIG. 1 depicts a prior art rotor and stator assembly in circular cross section.

FIG. 1 depicts a conventional Moineau style power section 100 in circular cross-section, in which stator 105 provides a helical cavity portion 110. In the embodiment of FIG. 1, helical cavity portion 110 is of an all-elastomer construction. Rotor 150 is located within stator 105. Stator 105 further comprises outer tube 140. Helical cavity portion 110 is deployed on the inside of outer tube 140, as is well known in the art.

FIG. 1 illustrates zones 170 in lobes 160 in which heat build up is known to occur during operation of power section 100. As described above, the cyclic deflection and rebound of elastomer in the interference fit between rotor 150 and stator 105 contributes to the heat build up in zones 170. Reactive torque from rotor 150 may also contribute to heat build up. As the heat build up deteriorates the elastomer in zones 170, weakness develops, and eventually cavities, cracks, and/or other types of failure have been observed to occur in these zones.

Figure 2:
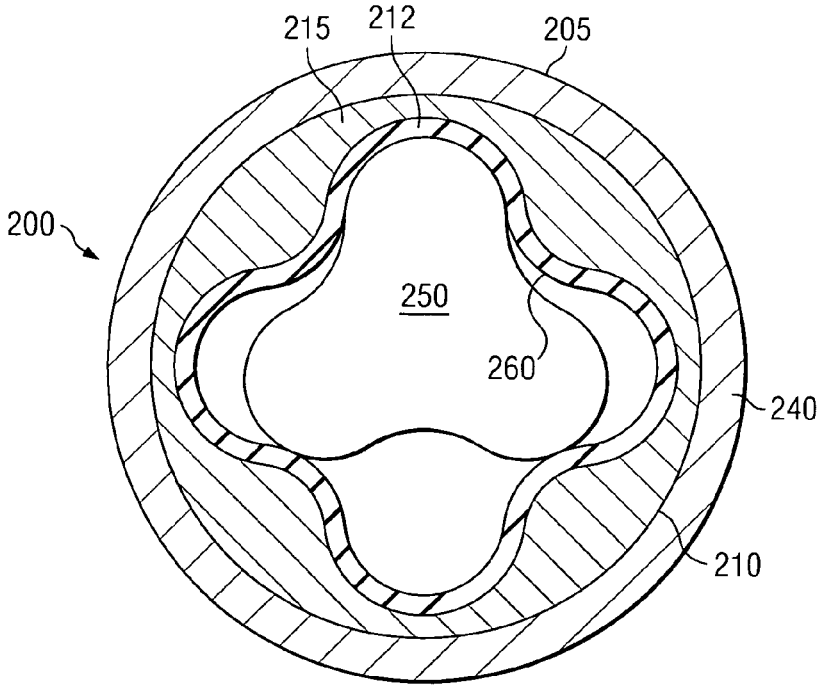
FIG. 2 depicts a rotor and stator assembly, also in circular cross section, in which elastomer liner 212 is reinforced by reinforcement material 215 provided by helical cavity component 210 on stator 205.

FIG. 2 depicts a Moineau style power section 200 in circular cross-section as described in exemplary embodiments disclosed in commonly-assigned, co-pending U.S. patent application Ser. No. 10/694,557, "COMPOSITE MATERIAL PROGRESSING CAVITY STATORS." In FIG. 2, rotor 250 is located within stator 205. Stator 205 provides outer tube 240 retaining helical cavity portion 210. Helical cavity portion 210 includes an elastomer liner 212. In the embodiment of FIG. 2, elastomer liner 212 has an even (uniform) thickness. Helical cavity portion 210 reinforces elastomer liner 212 and is made from a fiber reinforced composite reinforcement material 215.

As noted above, in view of contact stresses in the interference fit between rotor 250 and lobes 260, care is required in the selection of the thickness of elastomer liner 212 in stators 205 such as shown in FIG. 2 to avoid breakdown of elastomer liner 212. For analogous reasons, care is also required in the selection of reinforcement material 215 to avoid breakdown of reinforcement in lobes 260.

Figure 3:
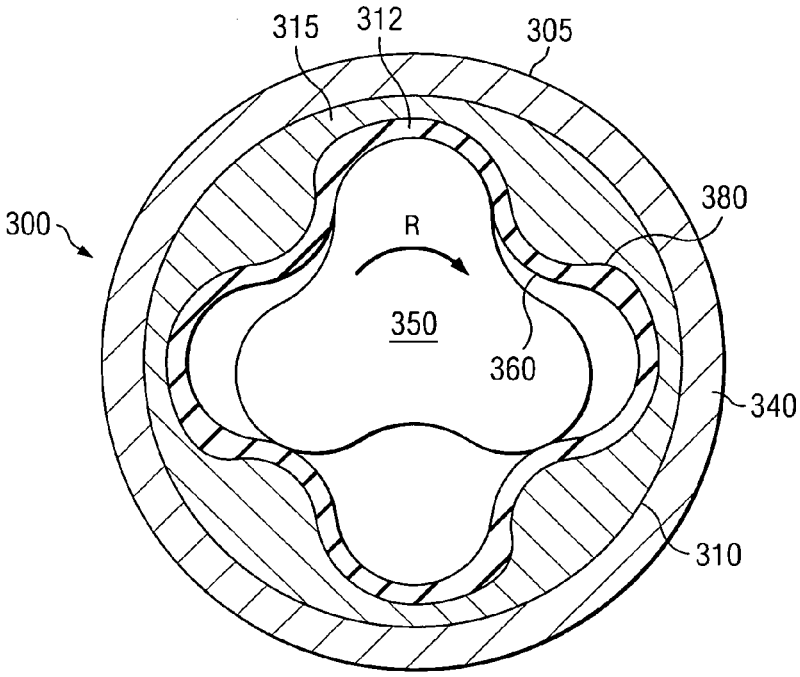
FIG. 3 depicts an embodiment of the present invention, comprising again a rotor and stator assembly in circular cross section, in which elastomer liner 312 is contoured asymmetrically, thicker on the loaded side of lobes 360 than on the unloaded side.

FIG. 3 depicts an exemplary embodiment of the present invention. FIG. 3 shows a Moineau style power section 300 in circular cross-section similar to that depicted in FIG. 2. In FIG. 3, rotor 350 is located within stator 305. Stator 305 provides outer tube 340 retaining helical cavity portion 310. Helical cavity portion 310 includes an elastomer liner 312 having a non-uniform thickness as described in more detail below. Helical cavity portion 310 reinforces elastomer liner 312 and is advantageously made from a reinforcement material 315 that deteriorates less than elastomer in the presence of heat build up in lobes 360. Reinforcement material 315 may be selected from any suitable material, such as (for example): hardened elastomer, steel wire in reinforced elastomer, extruded plastics, liquid crystal resin, fiberglass or other fiber reinforced composites, and metal (including copper, aluminum or steel castings, steel helical cavity portion formed integral with outer tube, or powdered metal fused in place by, e.g., brazing or HIP process).

In the exemplary embodiments shown on FIG. 3, elastomer liner 312 is contoured asymmetrically to provide thicker portions 380 on one side of lobes 360. Advantageously, thicker portions 380 are deployed on the loaded sides of lobes 360 as shown by the arrow of rotation R of rotor 350 (depicting clockwise rotation of the rotor as looking down the drill string in the exemplary embodiment shown). It will be appreciated that this invention is not limited by the direction of rotation of the rotor 350. In exemplary embodiments according to FIG. 3, thicker portions 380 of elastomer liner 312 may be, at their thickest point on the loaded sides of lobes 360, about 1.5 times as thick, and in some embodiments about twice as thick, than the thickness of elastomer liner 312 on the unloaded sides. It will be appreciated, however, that the invention is not limited in this regard.

Figure 4:
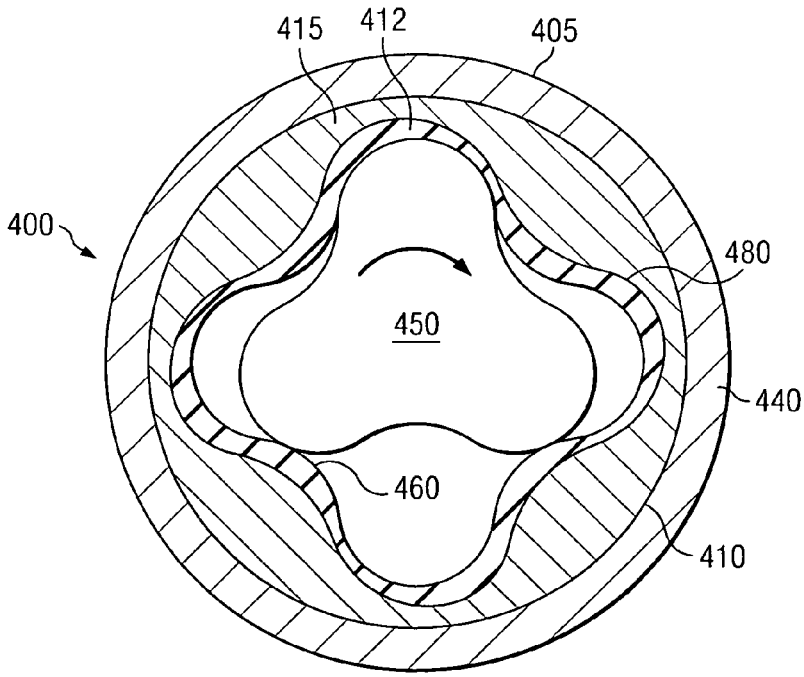
FIG. 4 depicts another embodiment of the present invention having an alternative asymmetric contouring of elastomer liner 412.

It will also be appreciated that the invention is also not limited to any particular cross-sectional shape of thicker portions 380. For example only, FIG. 4 depicts an alternative cross-sectional shape. Referring to FIG. 4, there is shown a further exemplary embodiment of the present invention with Moineau style power section 400 in circular cross-section generally as depicted in FIG. 3. Part numbers identified on FIG. 4 in the 400 series correspond to part numbers identified on FIG. 3 in the 300 series. Comparing FIG. 4 now to FIG. 3, however, it will be seen that elastomer liner 412 is asymmetrically contoured to provide thicker portions 480. In the embodiment of FIG. 4, the Moineau style profile of the inner surface of the liner 412 is rotationally offset from Moineau style profile (i.e., having helical lobes and grooves) of the outer surface of the liner 412 (or the inner surface of the reinforcement material 415). Again, analogous to the exemplary embodiment depicted in FIG. 3, the embodiment of FIG. 4 shows thicker portions 480 advantageously deployed on the loaded sides of lobes 460 as shown by the arrow of rotation R of rotor 450.

Figure 5:
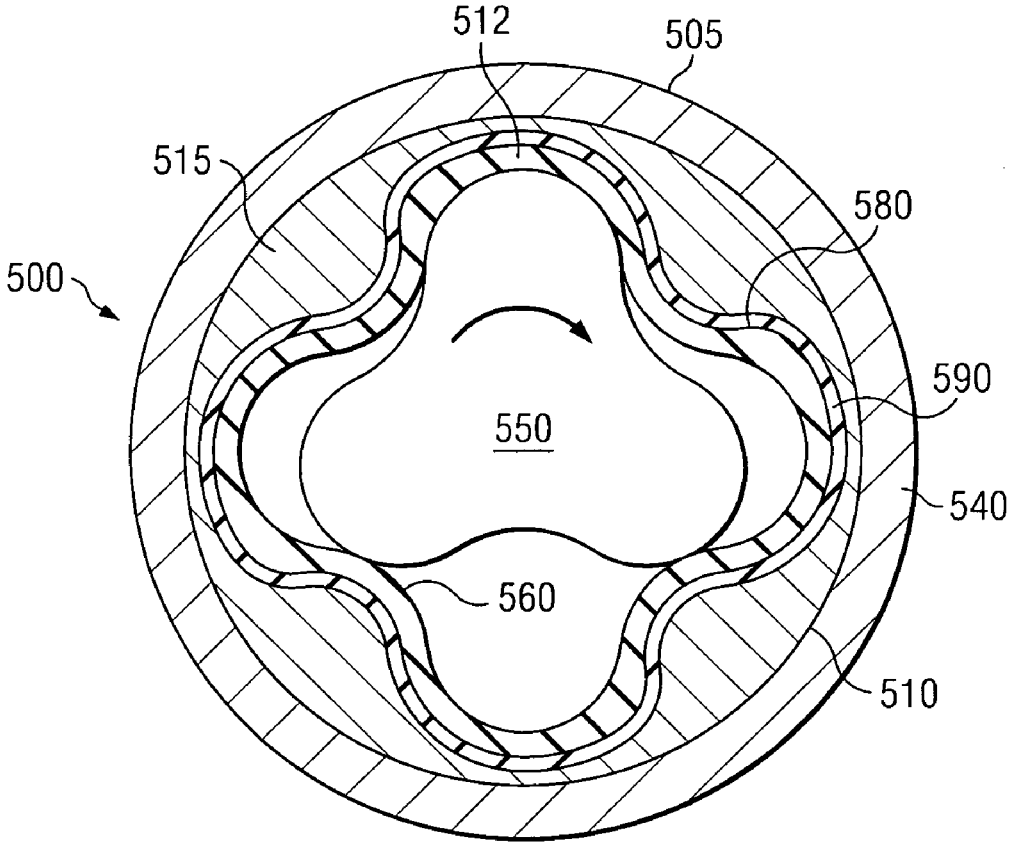
FIG. 5 depicts yet another embodiment of the present invention including a transition layer 590 deployed between the liner 512 and the reinforcement material 515.

In other embodiments, such as the exemplary embodiment shown on FIG. 5, there may be transition layers 590 in the stator lobe reinforcement of the elastomer liner 512. For example, FIG. 5 depicts the exemplary embodiment shown on FIG. 3 having one transition layer 590 with the elastomer liner 512 deployed thereon. Part numbers identified on FIG. 5 in the 500 series correspond to part numbers identified on FIG. 3 in the 300 series. The transition layer 590 separates the elastomer liner 512 and harder stator lobe reinforcement material 515, such as metal or other examples that have been herein described. The shape of the transition layer 590 in circular cross section may follow the asymmetrical contouring of the elastomer liner 512 as disclosed in exemplary fashion above. The transition layer 590 is advantageously made of a less resilient material than the elastomer liner 512, but of a more resilient material than the stator lobe reinforcement material 515. In this way, deeper resilience in the stator lobes 560 may be achievable to facilitate the interference fit between rotor 550 and stator 505 as the rotor 550 rotates. Harder stator lobe reinforcement material behind the transition layer 590 is also available to absorb heat build up better than elastomer or the transition layer.

With regard to transition layer embodiments, it will be appreciated that the invention is not limited to the foregoing description of the exemplary embodiment shown on FIG. 5 in which only one transition layer was described, and wherein the transition layer shape in circular cross section followed that of the elastomer liner. It will be understood that embodiments of the invention may have multiple transition layers. Similarly other embodiments may have transition layers whose shape in circular cross-section varies from that of the elastomer liner.

Although the present invention and its advantages have been described in detail, it should be understood that various changes, substitutions and alternations can be made herein without departing from the spirit and scope of the invention as defined by the appended claims.

I claim:

1. A stator for use in a Moineau style power section, the stator comprising:

an outer tube;

a helical cavity component deployed substantially coaxially in the outer tube, the helical cavity component providing an internal helical cavity and including a plurality of internal lobes;

the helical cavity component further including an outer reinforcement material retained by the outer tube and an inner resilient liner presented to the internal helical cavity;

the liner having a non-uniform thickness such that, when viewed in circular cross section, the thickness of the liner on one side of each of the lobes is greater than the thickness of the liner on an opposing side of each of the lobes.

2. The stator of claim 1, wherein the liner comprises an elastomer.

3. The stator of claim 1, wherein the reinforcement material is selected from the group consisting of hardened elastomers, steel wire reinforced elastomers, extruded plastics, liquid crystal resins, fiber reinforced composites including fiberglass, copper, aluminum, steel, and combinations thereof.

4. The stator of claim 1, wherein the reinforcement material is selected such that it has a greater resistance to thermal degradation than the liner.

5. The stator of claim 1, wherein the reinforcement material is less resilient than the liner.

6. The stator of claim 1, wherein the thickness of the liner at a thickest point on one side of each of the lobes is about 1.5 times greater than the thickness of the liner on the opposing side of each of the lobes.

7. The stator of claim 1, wherein the thickness of the liner at a thickest point on one side of each of the lobes is about twice the thickness of the liner on the opposing side of each of the lobes.

8. The stator of claim 1, wherein the non-uniform thickness of the liner takes the form of a Moineau style profile shape of an inner surface of the liner rotationally offset from a Moineau style profile shape of an outer surface of the liner when the stator is viewed in circular cross section.

9. The stator of claim 1, further comprising a transition layer deployed between the liner and the reinforcement material, the transition layer being less resilient than the liner and more resilient than the reinforcement material.

10. A stator for use in a Moineau style power section, the stator comprising:

a plurality of internal stator lobes, each of the stator lobes including a resilient liner deployed on an interior surface of the stator, the liner disposed to engage rotor lobes on a helical outer surface of a rotor when the rotor is positioned within the stator so that the rotor lobes are in a rotational interference fit with the stator lobes, rotation of the rotor in a predetermined direction causing the rotor lobes to (i) contact the stator lobes on a loaded side thereof as the interference fit is encountered, and (ii) pass by the stator lobes on a non-loaded side thereof as the interference fit is completed;

each of the stator lobes further including a reinforcement material for the resilient liner;

the stator further including a shape, when viewed in circular cross section, in which a thickness of the liner is greater on the loaded sides of the stator lobes than on the non-loaded sides thereof.

11. The stator of claim 10, wherein the reinforcement material is selected such that it has a greater resistance to thermal degradation than the liner.

12. The stator of claim 10, wherein the reinforcement material is selected such that it is less resilient than the liner.

13. The stator of claim 10, wherein:

the liner comprises an elastomer; and the reinforcement material is selected from the group consisting of hardened elastomers, steel wire reinforced elastomers, extruded plastics, liquid crystal resins, fiber reinforced composites including fiberglass, copper, aluminum, steel, and combinations thereof.

14. The stator of claim 10, wherein the thickness of the liner at a thickest point on the loaded sides of the stator lobes is about 1.5 times greater than the thickness of the liner on the non-loaded sides of the stator lobes.

15. The stator of claim 10, wherein the thickness of the liner at the thickest point on the loaded sides of the stator lobes is about twice the thickness of the liner on the non-loaded sides of the stator lobes.

16. The stator of claim 10, further comprising a transition layer deployed between the liner and the reinforcement material, the transition layer being less resilient than the liner and more resilient than the reinforcement material.

17. A subterranean drilling motor comprising:

a rotor having a plurality of rotor lobes on a helical outer surface of the rotor;

a stator including a helical cavity component, the helical cavity component providing an internal helical cavity and including a plurality of internal stator lobes;

the rotor deployable in the helical cavity of the stator such that the rotor lobes are in a rotational interference fit with the stator lobes, rotation of the rotor in a predetermined direction causing the rotor lobes to (i) contact the stator lobes on a loaded side thereof as the interference fit is encountered, and (ii) pass by the stator lobes on a non-loaded side thereof as the interference fit is completed;

the stator lobes including a reinforcement material and a resilient liner, the liner disposed to engage an outer surface of the rotor;

the liner having a non-uniform thickness such that the liner is thicker on the loaded sides of the lobes than on the non-loaded sides of the lobes.

18. The stator of claim 17, wherein the reinforcement material is selected such that it has a greater resistance to thermal degradation than the liner.

19. The stator of claim 17, wherein the reinforcement material is less resilient than the liner.

20. The stator of claim 17, wherein the thickness of the liner at a thickest point on the loaded sides of the stator lobes is about 1.5 times greater than the thickness of the liner on the non-loaded sides of the stator lobes.

21. The stator of claim 17, wherein the thickness of the liner at the thickest point on the loaded sides of the stator lobes is about twice the thickness of the liner on the non-loaded sides of the stator lobes.

22. A stator for use in a Moineau style power section, the stator comprising:

a helical cavity component, the helical cavity component providing an internal helical cavity, the helical cavity component including a plurality of internal lobes;

the helical cavity component further including an outer reinforcement material, a transition layer, and an inner resilient liner, the liner presented to the helical cavity, the transition layer interposed between the reinforcement material and the liner;

the transition layer being less resilient than the liner and more resilient than the reinforcement material;

the liner including a non uniform thickness such that, when viewed in circular cross section, the thickness of the liner on one side of each of the lobes is greater than the thickness of the liner on an opposing side of each of the lobes.

23. The stator of claim 22, wherein the thickness of the liner at a thickest point on one side of each of the lobes is about 1.5 times greater than the thickness of the liner on the opposing side of each of the lobes.

24. The stator of claim 22, wherein the thickness of the liner at a thickest point on one side of each of the lobes is about twice the thickness of the liner on the opposing side of each of the lobes.

25. The stator of claim 22, wherein:

the liner comprises an elastomer; and the reinforcement material is selected from the group consisting of hardened elastomers, steel wire reinforced elastomers, extruded plastics, liquid crystal resins, fiber reinforced composites including fiberglass, copper, aluminum, steel, and combinations thereof.

* * * * *